US006893508B2

(12) United States Patent
Andrews

(10) Patent No.: US 6,893,508 B2
(45) Date of Patent: May 17, 2005

(54) METHODS AND APPARATUS FOR FOOT SCRUBBING

(76) Inventor: Ricky Lee Andrews, 920 W. South Temple St., Salt Lake City, UT (US) 84104

( * ) Notice: Subject to any disclaimer, the term of this patent is extended or adjusted under 35 U.S.C. 154(b) by 163 days.

(21) Appl. No.: 10/220,928

(22) PCT Filed: Mar. 6, 2001

(86) PCT No.: PCT/US01/07039

§ 371 (c)(1),
(2), (4) Date: Sep. 6, 2002

(87) PCT Pub. No.: WO01/65990

PCT Pub. Date: Sep. 13, 2001

(65) Prior Publication Data

US 2003/0037395 A1 Feb. 27, 2003

Related U.S. Application Data

(60) Provisional application No. 60/186,973, filed on Mar. 6, 2000.

(51) Int. Cl.[7] ..... A47K 7/03

(52) U.S. Cl. ..... 134/6; 15/104.92; 15/160; 4/606

(58) Field of Search ..... 15/104.92, 160; 4/606; 134/6

(56) References Cited

U.S. PATENT DOCUMENTS

| | | | | |
|---|---|---|---|---|
| 2,591,331 A | * | 4/1952 | Baumbach | 15/160 |
| 3,283,756 A | * | 11/1966 | Turley | 601/166 |
| 3,548,439 A | | 12/1970 | Berst | |
| 3,973,286 A | | 8/1976 | Logan | |
| 5,163,200 A | | 11/1992 | Carlin et al. | |
| 5,813,078 A | | 9/1998 | Hogan, Sr. | |

* cited by examiner

*Primary Examiner*—Randall Chin

(57) ABSTRACT

A foot scrubbing device comprising a pedestal with a rough surface pad to step on and four vertical scrubbing posts for scrubbing in between the toes. Beneath the surface pad is a pressurized soap compartment having several channels through which liquid soap may be pumped to the surface of the surface pad via a foot pump. A person may clean his or her foot by placing it on the scrubbing surface so that the toes are placed in between the scrubbing posts. The person then uses his or her other foot to step on the pump pedal, thereby causing liquid soap to move to the surface of the pad where the foot is resting.

18 Claims, 5 Drawing Sheets

20
Soap Tube 42
14
16
Refill Plug 26
O - Ring 40
Suction Cups 30

Pump Pedal 20
Piston 22
Rubber Seals 44
Toe Brush 24

METHODS AND APPARATUS FOR FOOT SCRUBBING

This application claims the benefit of Provisional application Ser. No. 60/186,973, filed Mar. 6, 2000.

FIELD OF THE INVENTION

The present invention relates generally to methods and apparatus for scrubbing feet. More particularly, the present invention relates to methods and apparatus for scrubbing feet that include a foot pump for pumping liquid soap and/or water to the surface of the scrubbing device.

BACKGROUND

Various foot scrubbing devices exist in the art. Several foot scrubbing devices have scrubbing surfaces and are suited for use in a shower stall or bathtub. Many devices surround the foot with brushes, partially enclosing the foot. Among some of the most useful foot scrubbing devices include those that are designed to allow users to scrub their feet without the need for using their hands. This hands-free advantage can be particularly helpful to pregnant, old, or otherwise incapacitated people.

SUMMARY OF THE INVENTION

The present invention is a foot scrubbing device comprising a pedestal with a substantially planar, rough surface pad upon which to place the foot to be scrubbed. The scrubbing device includes a pressurized soap compartment, preferably below the surface pad, having several channels through which liquid soap and/or water may be pumped to the surface of the surface pad via a foot pump. The scrubbing device is secured to the floor of a shower stall or bathtub via friction means such as suction cups.

In the preferred embodiments, the scrubbing device further includes several scrubbing posts for scrubbing in between the toes. The scrubbing posts are preferably vertical and removable. The surface pad is also preferably removable.

Hence, in the preferred embodiments, a person cleans his or her foot by placing it on the scrubbing surface so that the toes are placed in between the scrubbing posts. The person then uses his or her other foot to step on the pump pedal, thereby causing liquid soap to move to the surface of the pad where the foot is resting.

Accordingly, some embodiments of the present invention provide a method and apparatus for foot scrubbing that provides for scrubbing the bottom of the feet and in between the toes without the need for manually applying soap to the feet.

Some embodiments of the present invention provide a method and apparatus for foot scrubbing with four toe bristles and a foot pump.

Furthermore, some embodiments of the present invention provide a method and apparatus for hands-free foot scrubbing that includes a substantially planar scrubbing surface, a compartment beneath the scrubbing surface to hold liquid soap, and a foot pump for pumping the liquid soap to the scrubbing surface.

Some embodiments of the present invention provide a method and apparatus for hands-free foot scrubbing that provides a foot pump to siphon liquid soap to the surface of a foot pedestal.

Some embodiments of the present invention provide a method and apparatus for hands-free foot scrubbing that provides a substantially planar scrubbing surface upon which to rest the bottom of the foot, a substantially rounded scrubbing surface for scrubbing in between the toes, and friction means to prevent the scrubbing surface from slipping upon a floor such as the floor of a shower stall or bathtub.

In addition, some embodiments of the present invention provide a method and apparatus for hands-free foot scrubbing with removable and serviceable scrubbing surfaces.

These and other features of the present invention will become more fully apparent from the following description, drawings, and the appended claims. Other features will likewise become apparent from the practice of the invention as set forth hereafter.

BRIEF DESCRIPTION OF THE DRAWINGS

The foregoing and other features of the present invention will become more fully apparent from the accompanying drawings when considered in conjunction with the following description and appended claims. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. In other instances, well-known features are omitted or simplified so as not to obscure the invention. However, the following detailed description in conjunction with the drawings will enable one skilled in the art to make and use the present invention even absent the omitted details.

The purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are for explanatory purposes only, that this description is not intended to limit the invention to these particular embodiments. Indeed, it is emphasized that the present invention can be embodied or performed in a variety of ways; the detailed description and the drawings do not limit the scope of the invention because the substantive scope of the present invention is to be limited only by the appended claims. The drawings and detailed description are merely representative of particular embodiments of the present invention.

Reference will now be made in detail to several embodiments of the invention. The various embodiments will be described in conjunction with the accompanying drawings wherein like elements are designated by like alphanumeric characters throughout.

Figure 1:
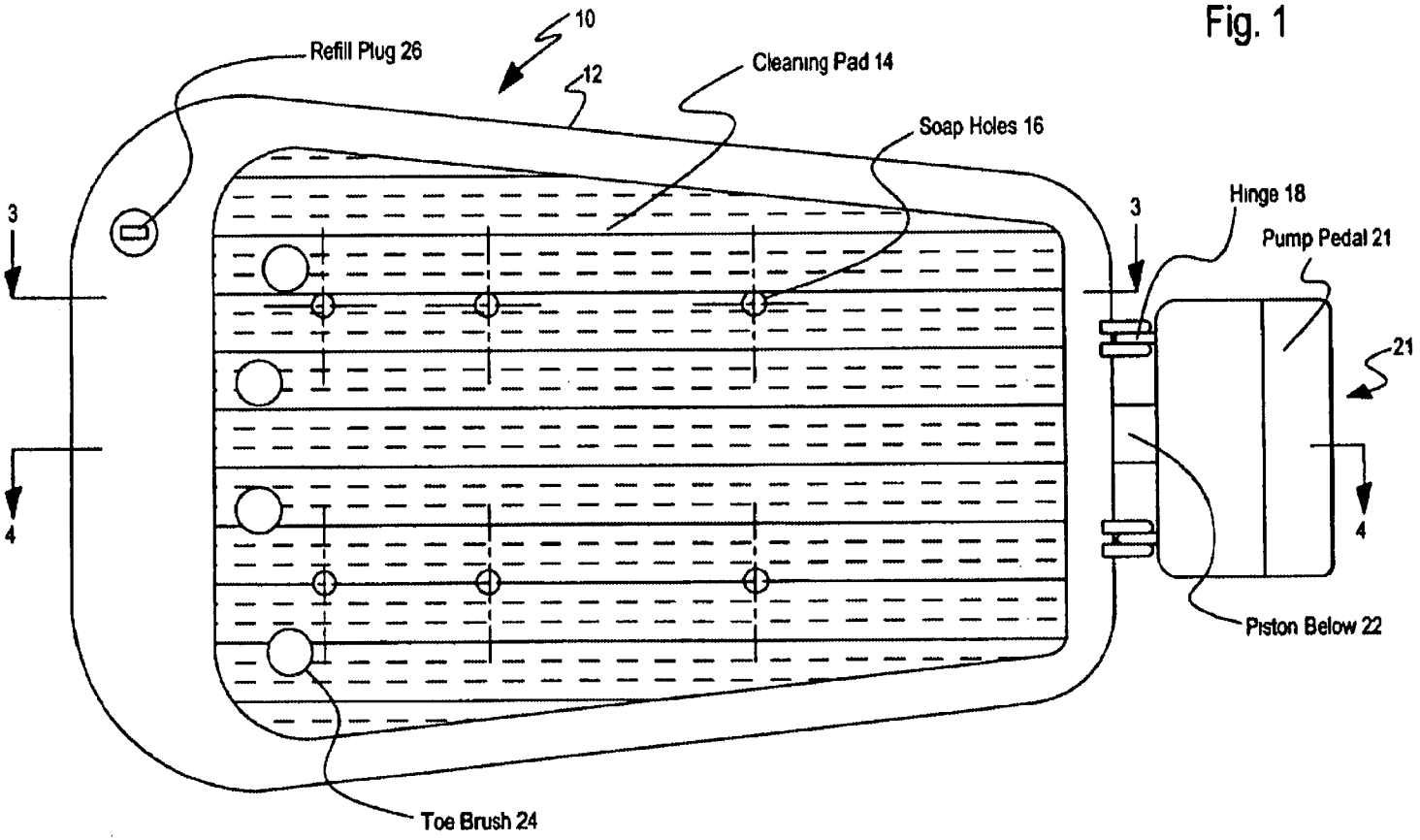
FIG. 1 is a plan view of a preferred embodiment of the present invention.

With reference now to the accompanying drawings, shown in FIG. 1 is a plan view of a preferred embodiment of a foot scrubbing device 10. The foot scrubbing device 10 basically comprises a tank/compartment/receptacle 12, a substantially planar scrubbing surface or cleaning pad 14, a plurality of soap holes 16, and a pump 21.

Figure 5:
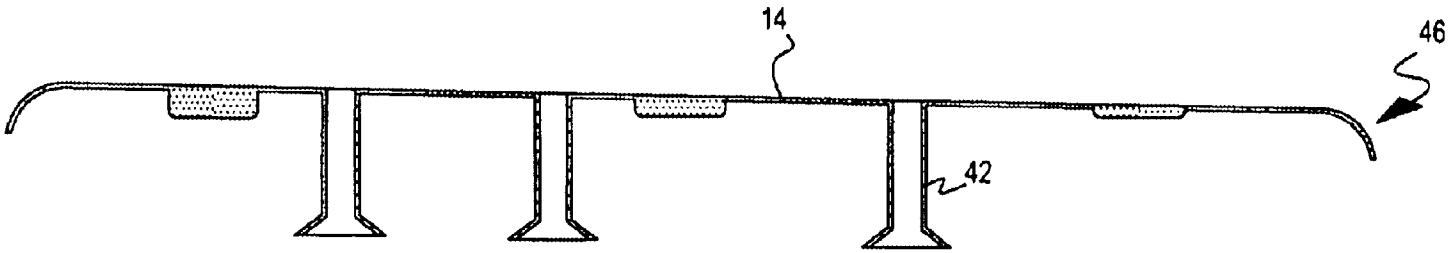
FIG. 5 shows a cross-sectional view of the top part of the tank in accordance with a preferred embodiment of the present invention.
Figure 6:
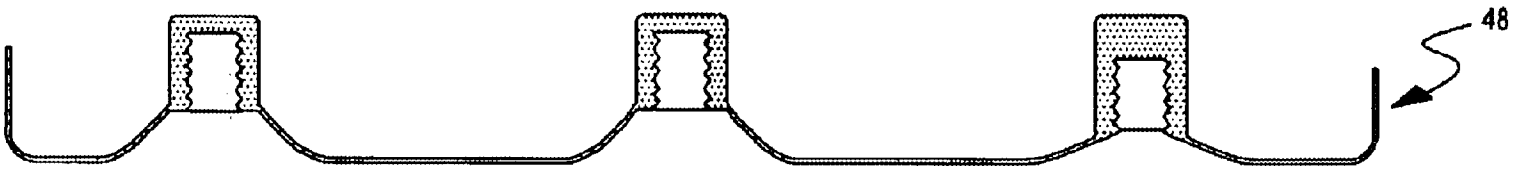
FIG. 6 shows a cross-sectional view of the bottom part of the tank in accordance with a preferred embodiment of the present invention.

The tank 12 is designed to contain liquid soap and/or water. In the preferred embodiments, the tank 12 is plastic and comprises a 2-part mold (shown, e.g., in FIGS. 5 and 6, as top portion 46 and bottom portion 48) that is preferably injection molded. The tank is substantially airtight so as to be pressurized so that the liquid soap can be pumped to the scrubbing surface 14 by the pump 21.

The surface pad 14 is substantially planar so as to serve as an essentially flat surface upon which to rest the bottom surface of a foot. The shape and size of the surface pad 14 is immaterial as long as the dimensions are such that a foot can be placed thereon. Surface pad 14 may be comprised of any rough material suitable for scrubbing skin. For example, the surface pad 14 may be made of AstroTurf®, sponge rubber, plastic bristles, or the like. In the preferred embodiments, the surface pad 14 is removable and thus serviceable. That is, if the surface pad 14 wears out or otherwise becomes destroyed, the pad 14 can be replaced.

The plurality of soap holes 16 are the means by which the liquid soap reaches the surface of the surface pad 14. The soap holes 16 are connected to the tops of soap tubes 42 (further described below in conjunction with FIGS. 3 and 4).

The pump 21 comprises a pump pedal 20, a hinge 18, and a piston 22. In the preferred embodiments, the piston is located below the pedal 20 so that when the user steps on the pedal 20, the piston 22 is compressed. The manner in which the pump 21 works is further discussed below in conjunction with FIGS. 3 and 4.

Figure 2:
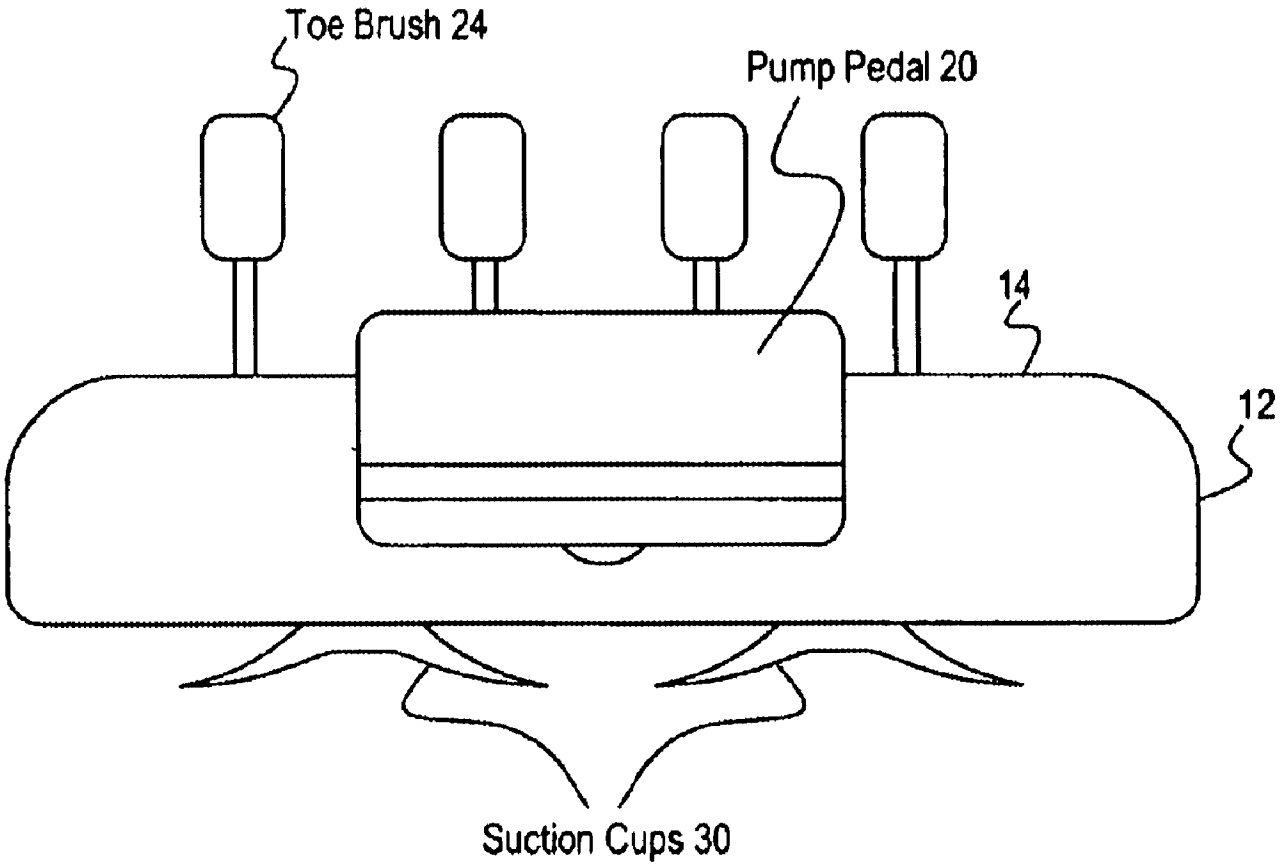
FIG. 2 is a rear elevational view, according to a preferred embodiment of the present invention, showing the portion of the foot scrubbing apparatus where the pedal pump is located.

FIG. 2 shows an embodiment of the present invention comprising scrubbing posts or toe brushes 24. In the preferred embodiments, there are four scrubbing posts 24 placed in an arc-like formation so as to comfortably fit in between the toes of a foot. Scrubbing posts 24 are preferably substantially vertical—i.e., in a basically upright position. Like the scrubbing pad 14, the scrubbing posts 24 may be formed of any rough material suitable for scrubbing skin. For example, the scrubbing posts 24 may be made of AstroTurf®, sponge rubber, plastic bristles, or the like. As with the scrubbing pad 14, in the preferred embodiments of the present invention, the scrubbing posts 24 are removable and thus serviceable. Also, in the preferred embodiments, the scrubbing pad 14 covers substantially the entire top surface of the device 10 in a continuous manner.

The foot scrubbing device 10 of the present invention also includes friction means 30 to prevent the device 10 from slipping on a surface such as a shower stall floor or a bathtub floor. In FIG. 2, the friction means 30 are suction cups.

Figures 3, 4:
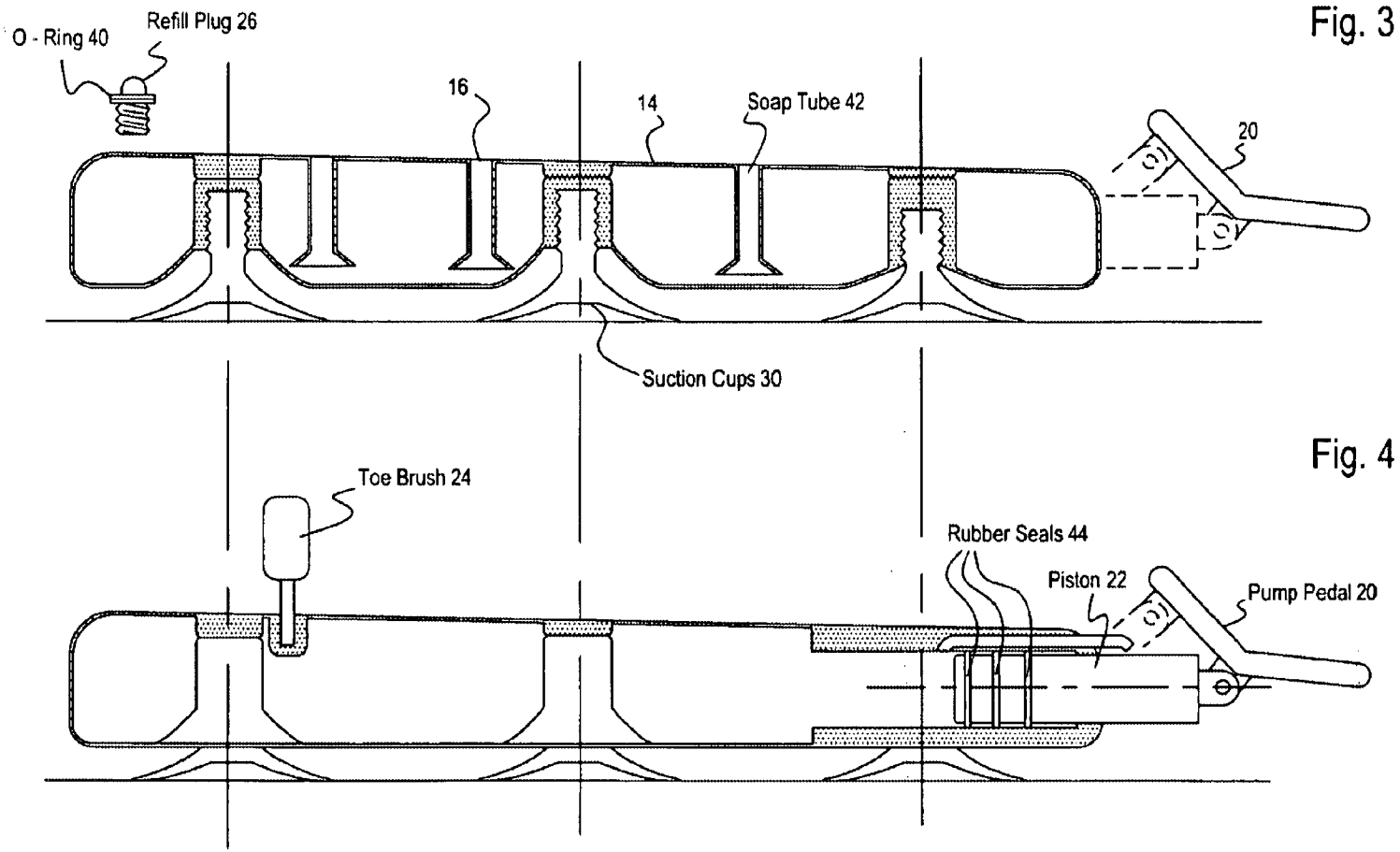
FIG. 3 is a cross-sectional view taken across lines 3—3 of the preferred embodiment shown in FIG. 1.
FIG. 4 is a cross-sectional view taken across lines 4—4 of the preferred embodiment shown in FIG. 1.

FIGS. 3 and 4 show cross-sectional views of the foot scrubbing device 10. FIG. 3 shows a cross-section through the soap tubes 42 of one embodiment of the present invention. Shown also is a refill plug 26 that preferably has an o-ring configuration 40. The refill plug 26 allows the user to refill the tank 12 with liquid soap and/or water.

FIG. 4 shows a cross-section through the center of the device 10 where the pump 21 is located. Note also that FIG. 4 shows the scrubbing posts or toe brushes 24, whereas FIG. 3 does not. This illustrates that, in the preferred embodiments, the scrubbing posts 24 are removable and thus serviceable and replaceable when worn out.

In operation, a user cleans his or her foot with the foot scrubbing device 10 by placing the foot on the scrubbing surface 14 so that, at least in the embodiments including scrubbing posts 24, the toes are placed in between the scrubbing posts 24. The user then uses his or her other foot to step on the pump pedal 20, thereby causing liquid soap to move to the surface of the pad where the foot is resting. The user then moves his or her foot around so as to enable the scrubbing pad 14 and scrubbing posts 24 to scrub the skin of the foot.

In the preferred embodiments, the pump 21 includes rubber seals 44 to provide enough pressure in the tank 12 to allow soap (shown, e.g., at 50 in FIG. 8) to be pumped up through the tank 12 to the surface of the surface pad 14. As was mentioned earlier, in the preferred embodiments, the piston 22 is located below the pedal 20 so that when the user steps on the pedal 20, the piston 22 is compressed. Note that the pedal 20 can be designed in accordance with FIGS. 3 and 4. Alternatively, a pedal 20' can be designed in accordance with FIGS. 7 and 8.

Figure 7:
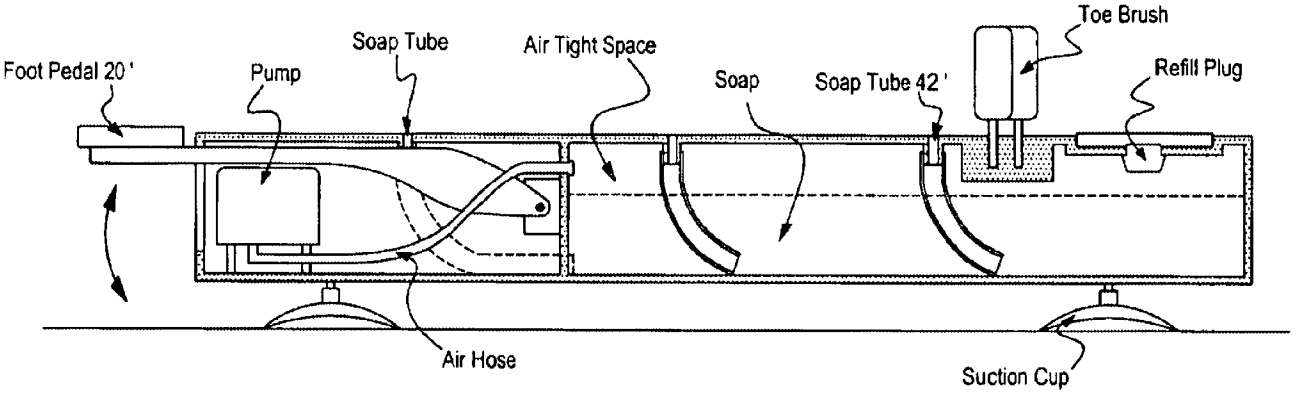
FIG. 7 is a cross-sectional view, similar to that shown in FIG. 3, of another embodiment of the present invention.
Figure 8:
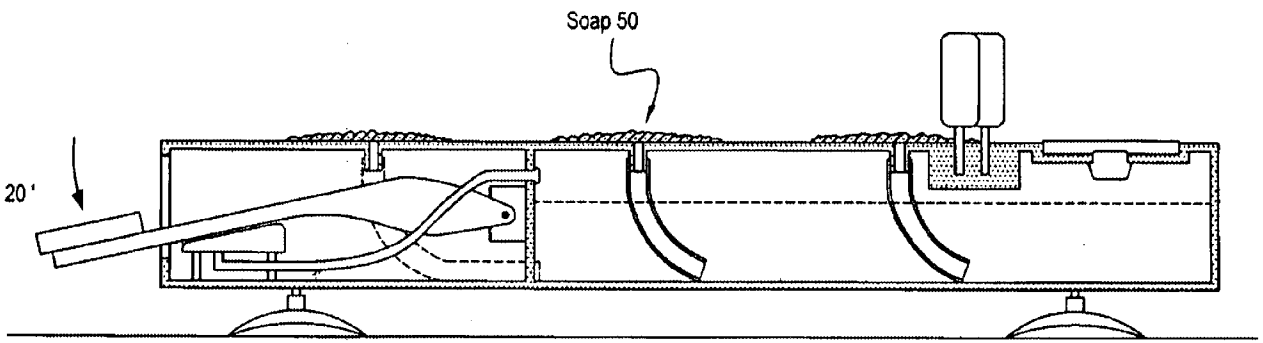
FIG. 8 is a cross-sectional view, similar to that shown in FIG. 4, of the embodiment shown in FIG. 7.

Note that FIGS. 7 and 8 show an embodiment of the present invention in which a soap tube or channel 42' is curve-shaped.

It is emphasized that the present invention may be embodied in various specific forms without departing from the scope of the present invention. For example, the foot scrubbing device 10 may be made of plastic or any other material suitable for wet environments; the shape of the scrubbing pad can be oblong, rectangular, or any other shape suitable for a foot to rest upon; the scrubbing pad can comprise patches of rough material or one integral patch of rough material. In addition, the foot scrubbing device might be used for scrubbing hands; it also might be used with animals as well as humans.

It is again underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations, alternatives, modifications, and equivalents that come within the meaning and range of equivalency of the claims are to be embraced within the scope of the claims.

What is claimed is:

1. A foot scrubbing device comprising:

a tank for holding liquid soap, said tank comprising a top portion and a bottom portion;

friction means for preventing said device from slipping on the surface upon which it rests, said friction means being located underneath the bottom portion of said tank;

a substantially planar scrubbing pad for scrubbing the bottom of a foot, said scrubbing pad substantially covering the top portion of said tank;

a plurality of soap holes on said substantially planar scrubbing pad; said soap holes being connected to soap tubes within said tank; and a foot pedal for pumping said liquid soap through said tubes to the surface of said scrubbing pad.

2. The device of claim 1 further including a plurality of scrubbing posts for scrubbing in between the toes of said foot.

3. The device of claim 2 wherein said scrubbing posts are substantially vertical.

4. The device of claim 2 wherein the number of said plurality of scrubbing posts is four.

5. The device of claim 2 wherein said scrubbing posts are removable.

6. The device of claim 2 wherein said scrubbing posts comprise bristles.

7. The device of claim 1 wherein said scrubbing pad is removable.

8. The device of claim 1 wherein said scrubbing pad comprises bristles.

9. The device of claim 1 wherein said friction means are suction cups.

10. The device of claim 1 wherein said soap tubes are vertically straight.

11. The device of claim 1 wherein said soap tubes are vertically curved.

12. An apparatus comprising:

a receptacle for holding liquid soap, said receptacle comprising a top portion and a bottom portion;

suction cups coupled to the bottom portion of said receptacle;

a substantially planar scrubbing surface for scrubbing the bottom of a foot, said scrubbing surface substantially covering the top portion of said receptacle;

a plurality of soap holes on said substantially planar scrubbing surface, said soap holes being connected to soap tubes within said receptacle;

a plurality of toe bristles for scrubbing in between the toes of said foot; and, a foot pedal for pumping said liquid soap through said tubes to the surface of said scrubbing surface.

13. The apparatus of claim 12 wherein said toe bristles are substantially vertical.

14. The apparatus of claim 12 wherein said toe bristles are removable.

15. The apparatus of claim 12 wherein the number of said plurality of toe bristles is four.

16. The apparatus of claim 14 wherein said scrubbing surface comprises bristles.

17. An apparatus for hands-free foot scrubbing comprising:

a receptacle for holding liquid soap, said receptacle comprising a top portion and a bottom portion;

a plurality of suction cups coupled to the bottom portion of said receptacle;

a substantially planar cleaning pad for scrubbing the bottom of a foot, said cleaning pad substantially covering the top portion of said receptacle, said pad being removable and serviceable;

a plurality of soap holes on said substantially planar cleaning pad, said soap holes being connected to a plurality of substantially vertical soap tubes within said receptacle;

four removable and serviceable toe bristles for scrubbing in between the toes of said foot, said toe bristles being substantially vertical; and, a foot pedal for pumping said liquid soap through said tubes to the surface of said cleaning pad.

18. A method comprising:

placing a foot on a substantially planar scrubbing pad coupled to the top surface of a liquid holding tank, said foot being positioned so that each toe of said foot is located in between a vertical scrubbing post, said vertical scrubbing post being coupled to said scrubbing pad so as to project upwardly from said scrubbing pad;

with another foot, stepping on a pump pedal to pump liquid up through a plurality of soap tubes within said tank, said soap holes being located on said substantially planar scrubbing pad; and scrubbing the foot placed on the substantially planar scrubbing pad, said scrubbing taking place via said scrubbing pad and said vertical scrubbing post.

* * * * *